US009546546B2

(12) United States Patent
Haubold et al.

(10) Patent No.: US 9,546,546 B2
(45) Date of Patent: Jan. 17, 2017

(54) MULTI CHIP MODULE HOUSING MOUNTING IN MWD, LWD AND WIRELINE DOWNHOLE TOOL ASSEMBLIES

(71) Applicant: BAKER HUGHES INCORPORATED, Houston, TX (US)

(72) Inventors: Carsten Haubold, Celle (DE); Andreas Peter, Celle (DE); Michell Schimanski, Lower Saxony (DE); Christian Preiser, Braunschweig (DE)

(73) Assignee: BAKER HUGHES INCORPORATED, Houston, TX (US)

( * ) Notice: Subject to any disclaimer, the term of this patent is extended or adjusted under 35 U.S.C. 154(b) by 429 days.

(21) Appl. No.: 14/276,331

(22) Filed: May 13, 2014

(65) Prior Publication Data

US 2015/0330208 A1 Nov. 19, 2015

(51) Int. Cl.

| | |
|---|---|
| ***E21B 47/01*** | (2012.01) |
| ***E21B 36/00*** | (2006.01) |
| ***H05K 5/02*** | (2006.01) |

(52) U.S. Cl.

CPC ..... *E21B 47/011* (2013.01); *E21B 36/003* (2013.01); *H05K 5/0213* (2013.01)

(58) Field of Classification Search

CPC ..... E21B 47/011; E21B 36/003; H05K 5/0213
See application file for complete search history.

(56) References Cited

U.S. PATENT DOCUMENTS

| | | | | |
|---|---|---|---|---|
| 3,746,106 | A * | 7/1973 | McCullough | E21B 7/04 175/45 |
| 4,400,858 | A | 8/1983 | Goiffon et al. | |
| 4,788,467 | A | 11/1988 | Plambeck | |
| 4,845,493 | A * | 7/1989 | Howard | E21B 47/122 324/323 |
| 5,212,495 | A * | 5/1993 | Winkel | E21B 47/011 324/338 |
| 5,447,207 | A * | 9/1995 | Jones | E21B 47/011 166/241.7 |
| 5,720,342 | A * | 2/1998 | Owens | E21B 36/001 166/302 |

(Continued)

OTHER PUBLICATIONS

Coburn, M., et al. Drilling Tests of an Active Vibration Damper, SPE105400—SPE International, Drilling Conference held in Amsterdam, The Netherlands, Feb. 20-22, 2007.

*Primary Examiner* — Blake Michener
(74) *Attorney, Agent, or Firm* — Mossman, Kumar & Tyler PC

(57) ABSTRACT

An apparatus for protecting an electronics module used in a borehole includes a borehole string section having an outer circumferential surface on which at least one pocket is formed, a mount associated with the at least one pocket, and a sleeve surrounding the section of the borehole string. The mount includes a housing, a lid, and a biasing member. The housing receives the electronics module and is seated on a seating surface of the at least one pocket. The lid encloses the housing within the at least one pocket. The biasing member is positioned between the lid and the housing. The sleeve presses the lid against the biasing member and the biasing member may responsively urge the housing against the seating surface. Related methods include protecting the electronics module with the mount.

16 Claims, 2 Drawing Sheets

(56) References Cited

U.S. PATENT DOCUMENTS 5,730,217 A * 3/1998 Owens ..... E21B 36/003 166/302
6,705,406 B2 3/2004 Das et al.
7,178,608 B2 2/2007 Mayes et al.
7,363,971 B2 4/2008 Rodney et al.
7,364,007 B2 * 4/2008 Garcia-Osuna ..... E21B 47/01 166/250.16
7,980,331 B2 * 7/2011 Hall ..... E21B 41/0085 166/65.1
2003/0072218 A1 * 4/2003 Smith ..... E21B 47/16 367/83
2005/0104176 A1 * 5/2005 Rodney ..... E21B 47/0002 257/678
2005/0150653 A1 * 7/2005 Hall ..... E21B 17/028 166/178
2005/0263668 A1 * 12/2005 Thigpen ..... F16F 7/08 248/560
2007/0023904 A1 2/2007 Salmon
2007/0095543 A1 * 5/2007 Tchakarov ..... E21B 47/011 166/380
2008/0314638 A1 * 12/2008 Kaul ..... E21B 47/011 175/17
2010/0108306 A1 5/2010 Cooper
2012/0096935 A1 * 4/2012 Finke ..... E21B 47/01 73/152.03
2012/0228028 A1 9/2012 Turner et al.
2013/0000399 A1 * 1/2013 Lilly ..... E21B 47/011 73/152.58
2013/0087903 A1 4/2013 Cherchali et al.
2013/0105140 A1 5/2013 Barbara et al.
2013/0126171 A1 * 5/2013 Garnier ..... E21B 47/011 166/303
2013/0168092 A1 7/2013 Evans
2013/0213711 A1 * 8/2013 Cartellieri ..... E21B 47/011 175/40
2013/0235537 A1 * 9/2013 Swett ..... H05K 5/0213 361/752
2014/0260591 A1 * 9/2014 Rodgers ..... G10K 11/16 73/152.58
2014/0262513 A1 * 9/2014 Chau ..... E21B 17/003 175/40
2015/0252666 A1 * 9/2015 Wang ..... E21B 47/011 166/66
2015/0275652 A1 * 10/2015 Fanini ..... E21B 47/011 166/381
2015/0337641 A1 * 11/2015 Mueller ..... E21B 47/011 166/66
2015/0337644 A1 * 11/2015 Mueller ..... E21B 47/01 166/242.1

* cited by examiner

MULTI CHIP MODULE HOUSING MOUNTING IN MWD, LWD AND WIRELINE DOWNHOLE TOOL ASSEMBLIES

FIELD OF THE DISCLOSURE

This disclosure pertains generally to devices and methods for providing shock and vibration protection for borehole devices.

BACKGROUND OF THE DISCLOSURE

Exploration and production of hydrocarbons generally requires the use of various tools that are lowered into a borehole, such as drilling assemblies, measurement tools and production devices (e.g., fracturing tools). Electronic components may be disposed downhole for various purposes, such as control of downhole tools, communication with the surface and storage and analysis of data. Such electronic components typically include printed circuit boards (PCBs) that are packaged to provide protection from downhole conditions, including temperature, pressure, vibration and other thermo-mechanical stresses.

In one aspect, the present disclosure addresses the need for enhanced shock and vibration protection for electronic components and other shock and vibration sensitive devices used in a borehole.

SUMMARY OF THE DISCLOSURE

In aspects, the present disclosure provides an apparatus for protecting an electronics module used in a borehole. The apparatus may include a section of a borehole string having an outer circumferential surface on which at least one pocket is formed, a mount associated with the at least one pocket, and a sleeve surrounding the section of the borehole string. The mount may include a housing, a lid, and a biasing member. The housing receives the electronics module and is seated on a seating surface of the at least one pocket. The lid encloses the housing within the at least one pocket. The biasing member is positioned between the lid and the housing. The sleeve may press the lid against the biasing member and the biasing member may responsively urge the housing against the seating surface.

In further aspects, the present disclosure also provides an apparatus for protecting electronics modules used in a borehole where the apparatus includes a borehole string section having an outer circumferential surface on which a plurality of pockets are circumferentially distributed, a mount associated with each pocket, and a sleeve. Each mount may include a heat transfer pad positioned on a seating surface of each pocket, a housing receiving and hermetically sealing an associated electronics module, the housing being seated on the heat transfer pad, a lid enclosing the housing within the associated pocket, and a biasing member positioned between the lid and the housing. The sleeve surrounds the borehole string section and secures each lid of each mount within the associated pocket. The sleeve interfering engages each lid to compress the associated biasing member and each biasing member responsively urges the associated housing against the associated heat transfer pad. Also, each pocket may include at least one passage connecting each pocket to a compartment in the borehole section for receiving electrical equipment.

In aspects, the present disclosure also provides a method for protecting a module used in a borehole. The method may include forming at least one pocket in an outer circumferential surface of a section of a borehole string; and disposing a mount at least partially into the at least one pocket. The mount may include a housing receiving the electronics module, the housing being seated on a seating surface of the at least one pocket, a lid enclosing the housing within the at least one pocket, a biasing member positioned between the lid and the housing, and a sleeve surrounding the section of the borehole string. The method also includes securing the lid within the at least one pocket by using the sleeve to press the lid against the biasing member, which responsively urges the housing against the seating surface.

Examples of certain features of the disclosure have been summarized rather broadly in order that the detailed description thereof that follows may be better understood and in order that the contributions they represent to the art may be appreciated.

BRIEF DESCRIPTION OF THE DRAWINGS

For a detailed understanding of the present disclosure, reference should be made to the following detailed description of the embodiments, taken in conjunction with the accompanying drawings, in which like elements have been given like numerals, wherein.

DETAILED DESCRIPTION

Drilling conditions and dynamics produce sustained and intense shock and vibration events. These events can induce electronics failure, fatigue, and accelerated aging in the devices and components used in a drill string. In aspects, the present disclosure provides mountings and related methods for protecting these components from the energy associated with such shock events.

Figure 1:
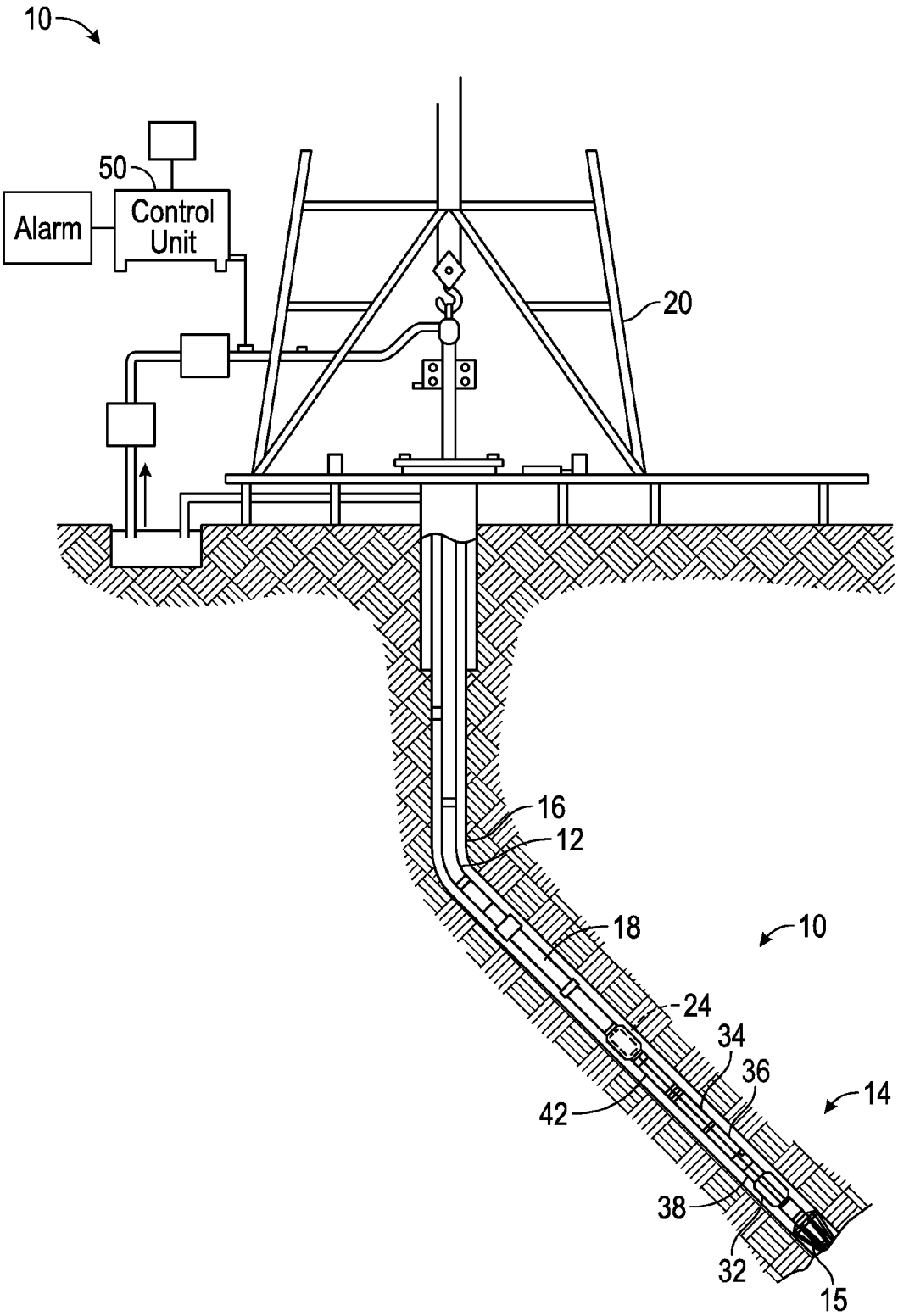
FIG. 1 shows a schematic of a well system that may use one or more mounts according to the present disclosure.

Referring now to FIG. 1, there is shown one illustrative embodiment of a drilling system 10 utilizing a borehole string 12 that may include a bottomhole assembly (BHA) 14 for directionally drilling a borehole 16. While a land-based rig is shown, these concepts and the methods are equally applicable to offshore drilling systems. The borehole string 12 may be suspended from a rig 20 and may include jointed tubulars or coiled tubing. In one configuration, the BHA 14 may include a drill bit 15, a sensor sub 32, a bidirectional communication and power module (BCPM) 34, a formation evaluation (FE) sub 36, and rotary power devices such as drilling motors 38. The sensor sub 32 may include sensors for measuring near-bit direction (e.g., BHA azimuth and inclination, BHA coordinates, etc.) and sensors and tools for making rotary directional surveys. The system may also include information processing devices such as a surface controller 50 and/or a downhole controller 42. Communication between the surface and the BHA 14 may use uplinks and/or downlinks generated by a mud-driven alternator, a mud pulser and/or conveyed using hard wires (e.g., electrical conductors, fiber optics), acoustic signals, EM or RF.

One or more electronics modules 24 incorporated into the BHA 14 or other component of the borehole string 12 may include components as necessary to provide for data storage and processing, communication and/or control of the BHA 14. These components may be disposed in suitable compartments formed in or on the borehole string 12. Exemplary electronics in the electronics module include printed circuit board assemblies (PCBA) and multiple chip modules (MCM's).

Figure 2:
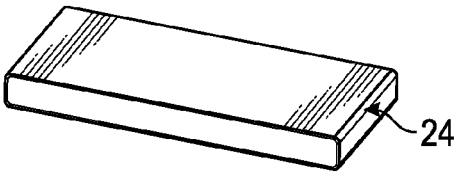
FIG. 2 illustrates one embodiment of an electronics module that may be protected using a mount according to the present disclosure.

Referring to FIG. 2, there is shown one non-limiting embodiment of a module 24 that may be used with the borehole string 12 of FIG. 1. The module 24 can be a BHA's tool instrument module, which can be a crystal pressure or temperature detection, or frequency source, a sensor acoustic, gyro, accelerometer, magnetometer, etc., sensitive mechanical assembly, MEM, multichip module MCM, Printed circuit board assembly PCBA, flexible PCB Assembly, Hybrid PCBA mount, MCM with laminate substrate MCM-L, multichip module with ceramic substrate e.g. LCC or HCC, compact Integrated Circuit IC stacked assemblies with ball grid arrays or copper pile interconnect technology, etc. All these types of modules 24 often are made with fragile and brittle components which cannot take bending and torsion forces and therefore benefit from the protection of the package housing and layered protection described below.

Exemplary mounts for protecting shock and vibration sensitive equipment such as the electronics module 24 are described below. Although the embodiments described herein are discussed in the context of electronics modules, the embodiments may be used in conjunction with any component that would benefit from a structure having high damping, high thermal conduction, and/or low fatigue stress. Furthermore, although embodiments herein are described in the context of downhole tools, components and applications, the embodiments are not so limited.

Figure 3:
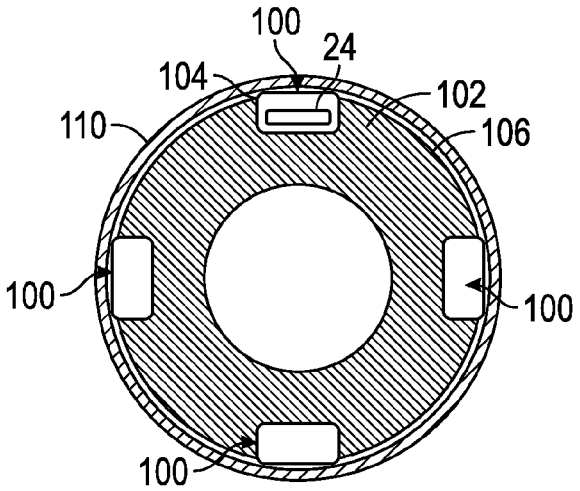
FIG. 3 illustrates an end view of a section of a BHA that has a plurality of electronics protected by mounts according to one embodiment of the present disclosure.

FIG. 3 schematically illustrates a mount 100 for protecting a module 24 (FIG. 2) from shock and vibration. The mount 100 may be formed in a section 102 of the borehole string 12 of FIG. 1. For example, the section 102 may be a drill collar, a sub, a portion of a jointed pipe, or the BHA 14. The mount 100 may be secured within a pocket 104 formed on an outer circumferential surface 106 of the section 102. A sleeve 110 surrounds the section 102 secures the mounts 100 within the pockets 104. The sleeve 110 may be formed of a non-magnetic material such as stainless steel. While four mounts 100 are shown circumferentially distributed on the section 102, it should be understood that greater or fewer number of mounts 100 may be used. In embodiments, one common continuous sleeve 110 secures a plurality of circumferentially distributed mounts 100.

Figure 4:
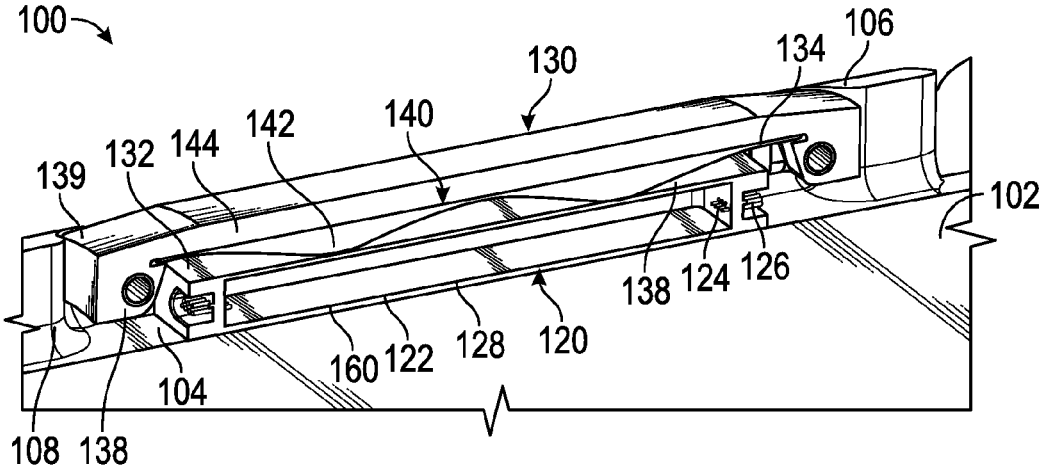
FIG. 4 illustrates a sectional view of a section of the BHA that includes a mount according to one embodiment of the present disclosure.

FIG. 4 sectionally illustrates one embodiment of a mount 100 that may be used to resiliently secure the module 24 (FIG. 2) within the pocket 104. The pocket 104 may be pre-formed or machined (e.g., milled) into the section 102 and include passages 108 for wiring and other equipment that connect to the module 24 (FIG. 2). The passages 108 may connect the pocket 104 with other compartments, chambers, or cavities that contain electrical equipment such as sensors (not shown). The mount 100 may include a housing 120, a lid 130, and a biasing member 140.

The housing 120 provides a hermetically sealed environment for the module 24 (FIG. 2). The housing 120 may include a sealed casing 122 formed of a metal such as titanium or Kovar. These types of metals have a thermal expansion similar to the ceramic, glass, composite, or other material used to encase the module 24 (FIG. 2). Electrical connections to the module 24 may be made using the internal connectors 124 and the external connectors 126. It should be understood that the shown configuration for the housing 120 is merely one non-limiting example of a housing 120 that may be used in connection with mounts 100 according to the present disclosure.

Figure 5:
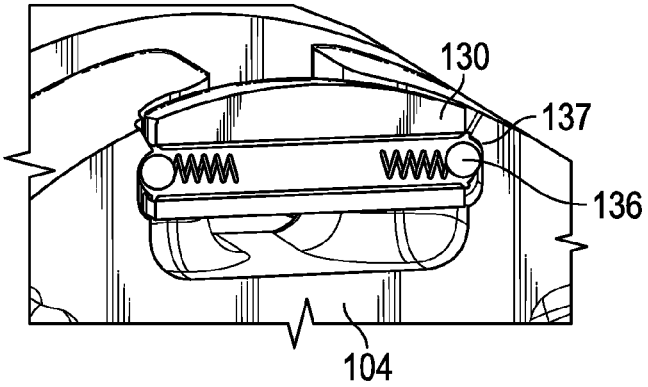
FIG. 5 illustrates a latching arrangement that may be used with a mount according to one embodiment of the present disclosure.

The lid 130 encloses the housing 120 within the pocket 104. The lid 130 may include a recess 132 for receiving the biasing element 140 and the housing 120. The recess 132 may include a shoulder 134 or other similar feature that contacts the housing 120 to minimize movement in the axial direction. As used herein, the term axial refers to a longitudinal directional along the borehole string 12 (FIG. 1). Referring to FIG. 5, the lid 130 may optionally include latches 136 that secure the lid 130 within the pocket 104. The latches 136 may be positioned at an end 138 of the lid 30 and include spring-biased balls or other locking mechanisms engage a suitable profile 137 formed in the pocket 104. The lid 130 may be formed of a suitable non-magnetic material such as stainless steel. Additionally, the lid 130 may include a ramped or sloped portions 139 that allow the sleeve 110 to slide over the lid 130 during final installation.

The biasing member 140 applies a spring force that presses the housing 120 against a seating surface 128 of the pocket 104. The biasing member 140 may be any structure that has range of elastic deformation sufficient to generate a persistent spring force. As shown, the biasing member 140 may be a leaf spring that has one or more apex regions 142 that compressively contact the housing 120. While the apex regions 142 are shown in a medial section of the biasing member 140, it should be understood that the apex regions 142 may distributed throughout the biasing member 140. For instance, apex regions 142 may be located at a distal end 144 of the biasing member 120. Other springs such as coil springs or spring washers, may be used. Additionally, pressurized fluids may be used to generate a spring force. Also, while point contacts are shown, it should be understood that the biasing member 140 may be formed as a body such as a pad that distributes compressive force of a relatively large surface area. The biasing member 140 may be retained in a suitable groove or slot in the recess 132.

Some embodiments may include a heat transfer pad 160 positioned between the housing 120 and the seating surface 128. One non-limiting embodiment of a heat transfer pad 160 may be formed at least partially of a visco-elastic material. As used herein, a viscoelastic material is a material having both viscous and elastic characteristics when undergoing deformation. More generally, the heat transfer pad 160 may be formed of any material that transfers heat from the housing 120 to the section 102 and/or provides shock absorption.

It should be understood that the mounts according to the present disclosure are susceptible to numerous variants. For example, circumferential springs may be used to fix the mounts inside the pocket.

Referring not to FIGS. 1-5, in one mode of use, each module 24 is first inserted into a housing 120. The internal electrical connections 124 are made up and the housing 120 is hermetically sealed. Next, the housing 120 is disposed into the pocket 104 and wires (not shown) are connected to the external electrical connections 126. The lid 130 and biasing member 140 are then set over the housing 120. Depressing the lid 130 allows the latching members 136 to snap the lid 130 into place in the pocket 104. After all the modules 24 are installed, the sleeve 110 is slid over the pockets 104. The sleeve 110 interferingly engages the lid 130 because an inner surface of the sleeve 110 is more radially inward that an outer surface of the lid 130 when the lid 130 rests on a relaxed biasing member 140. This interfering engagement forces the lid 130 move radially inward, which compresses the biasing member 140. In response to being compressed, the biasing member 140 presses the housing 120 against the heat transfer pad 160. Thus, the module 24 is restrained against lateral motion; i.e., motion transverse to the longitudinal axis of the tool. Additionally, the shoulder 134 of the lid 130 and frictional forces at the heat transfer pad 160 minimize movement of the housing 130 in the axial direction or sliding motion generally.

During drilling or other activities in the borehole 16, the section 102 may encounter shocks and vibrations. Advantageously, the mount 100 minimizes movement of the housing 120 and enclosed module 24 in the lateral and axial directions when subjected to these movements. Also, the heat transfer pad 160 conducts heat from the housing 120 to a suitable heat sink, such as a drilling mud flowing in the borehole string 12.

While the foregoing disclosure is directed to the one mode embodiments of the disclosure, various modifications will be apparent to those skilled in the art. It is intended that all variations be embraced by the foregoing disclosure.

We claim:

1. An apparatus for protecting an electronics module used in a borehole, comprising:

a section of a borehole string having an outer circumferential surface on which at least one pocket is formed;

a mount associated with the at least one pocket, wherein the mount includes:

a housing receiving the electronics module, the housing being seated on a seating surface of the at least one pocket, a lid enclosing the housing within the at least one pocket, and a biasing member positioned between the lid and the housing; and a sleeve surrounding the section of the borehole string and securing the lid within the at least one pocket, the sleeve pressing the lid against the biasing member, the biasing member responsively urging the housing against the seating surface, and wherein the housing hermetically seals the electronics module.

2. The apparatus according to claim 1, further comprising a heat transfer pad positioned between the housing and the seating surface.

3. The apparatus according to claim 2, wherein the heat transfer pad is formed of a viscoelastic material.

4. The apparatus according to claim 1, wherein the section has a plurality of pockets distributed on the outer circumferential surface, and wherein each pocket has an associated mount.

5. The apparatus of claim 1, wherein the section of the borehole string is one of: (i) a drill collar, (ii) a sub, and (iii) a bottomhole assembly.

6. The apparatus of claim 1, wherein the at least one pocket includes at least one passage connecting the at least one pocket to a compartment in the borehole string for receiving electrical equipment.

7. The apparatus of claim 1, wherein the sleeve interferingly engages the lid.

8. The apparatus of claim 1, wherein the borehole string is configured to drill the borehole.

9. An apparatus for protecting electronics modules used in a borehole, comprising:

a section of a borehole string having an outer circumferential surface on which a plurality of pockets are circumferentially distributed, each pocket including at least one passage connecting each pocket to a compartment in the borehole section for receiving electrical equipment;

a mount associated with each pocket, wherein each mount includes:

a heat transfer pad positioned on a seating surface of each pocket, a housing receiving and hermetically sealing an associated electronics module, the housing being seated on the heat transfer pad, a lid enclosing the housing within the associated pocket, and a biasing member positioned between the lid and the housing; and a sleeve surrounding the section of the borehole string and securing each lid of each mount within the associated pocket, the sleeve interfering engaging each lid to compress the associated biasing member, each biasing member responsively urging the associated housing against the associated heat transfer pad.

10. A method for protecting a module used in a borehole, comprising:

forming at least one pocket in an outer circumferential surface of a section of a borehole string;

disposing a mount at least partially into the at least one pocket, wherein the mount includes:

a housing receiving the electronics module, the housing being seated on a seating surface of the at least one pocket, a lid enclosing the housing within the at least one pocket, and a biasing member positioned between the lid and the housing; and securing the lid within the at least one pocket by using a sleeve surrounding the section of the borehole string, the sleeve pressing the lid against the biasing member, which responsively urges the housing against the seating surface, and hermetically sealing the electronics module inside the housing.

11. The method according to claim 10, further comprising positioning a heat transfer pad between the housing and the seating surface.

12. The method according to claim 11, wherein the heat transfer pad is formed of a viscoelastic material.

13. The method according to claim 10, further comprising forming and distributing a plurality of pockets on the outer circumferential surface, wherein each pocket has an associated mount, and wherein the sleeve secures each of the mounts in the associated pocket.

14. The method of claim 10, wherein the section of the borehole string is one of: (i) a drill collar, (ii) a sub, (iii) a bottomhole assembly.

15. The method of claim 10, further comprising forming at least one passage connecting the at least one pocket to a compartment in the borehole section for receiving electrical equipment.

16. The method of claim 10, drilling the borehole using the borehole string.

* * * * *